US010240764B2

(12) United States Patent
Morales

(10) Patent No.: US 10,240,764 B2
(45) Date of Patent: Mar. 26, 2019

(54) LIGHTING FIXTURE FOR DOWNLIGHT WITH ADJUSTABLE MOUNTING BRACKET

(71) Applicant: Hubbell Incorporated, Shelton, CT (US)

(72) Inventor: Luis Morales, Fountain Inn, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/817,381

(22) Filed: Nov. 20, 2017

(65) Prior Publication Data

US 2018/0142871 A1 May 24, 2018

Related U.S. Application Data

(60) Provisional application No. 62/425,121, filed on Nov. 22, 2016.

(51) Int. Cl.

| | |
|---|---|
| ***F21V 21/14*** | (2006.01) |
| ***F21S 8/02*** | (2006.01) |
| ***F21V 21/04*** | (2006.01) |
| *F21V 23/00* | (2015.01) |
| *F21V 7/04* | (2006.01) |
| *F21Y 115/10* | (2016.01) |
| *F21V 23/06* | (2006.01) |
| *F21V 5/04* | (2006.01) |
| *F21V 11/00* | (2015.01) |

(52) U.S. Cl.

CPC ..... *F21V 21/14* (2013.01); *F21S 8/026* (2013.01); *F21V 21/047* (2013.01); *F21V 21/049* (2013.01); *F21V 5/04* (2013.01); *F21V 7/041* (2013.01); *F21V 11/00* (2013.01); *F21V 23/004* (2013.01); *F21V 23/06* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 7,677,766 | B2 | 3/2010 | Boyer | |
| 8,201,968 | B2 | 6/2012 | Maxik et al. | |
| 8,672,518 | B2 | 3/2014 | Boomgaarden et al. | |
| 9,010,956 | B1 * | 4/2015 | Davis | F21V 17/06 362/147 |
| 2009/0296387 | A1 | 12/2009 | Reisenauer et al. | |
| 2011/0080750 | A1 | 4/2011 | Jones et al. | |
| 2012/0182744 | A1 | 7/2012 | Santiago et al. | |
| 2015/0198324 | A1 | 7/2015 | O'Brien et al. | |

OTHER PUBLICATIONS

PCT International Search Report & Opinion for corresponding PCT Application No. PCT/US2017/62512, dated Mar. 6, 2018, 9 pages.

* cited by examiner

*Primary Examiner* — Kristy A Haupt

(74) *Attorney, Agent, or Firm* — Dority & Manning, P.A.

(57) ABSTRACT

Lighting fixtures for use with a can downlight are provided. In some embodiments, The lighting fixture includes a fixture housing having a recess. The fixture housing has a shape adapted to fit at least partially within a can housing. The lighting fixture includes one or more light sources disposed within the recess of the fixture housing. The lighting fixture includes an adjustable mounting bracket attached to the fixture housing. The adjustable mounting bracket is movable between a plurality of different positions to adapt the adjustable mounting bracket for engaging can housings of a plurality of different sizes.

17 Claims, 5 Drawing Sheets

LIGHTING FIXTURE FOR DOWNLIGHT WITH ADJUSTABLE MOUNTING BRACKET

PRIORITY CLAIM

The present application claims the benefit of priority of U.S. Provisional Patent Application No. 62/425,121, entitled "Lighting Fixture for Downlight with Adjustable Mounting Bracket," filed Nov. 22, 2016, which is incorporated herein by reference for all purposes.

FIELD

The present subject matter relates generally to lighting fixtures.

BACKGROUND

Lighting fixtures can be used for providing lighting for a space, such as a building or room. Can downlights, such as recessed can downlights, are some of the most commonly used lighting fixtures. Can downlights typically include a generally cylindrical "can" housing and a light source (e.g., incandescent light source) disposed within the housing. In many cases, the can housing is recessed into a surface, such as a ceiling, making replacement or access to the can housing difficult. In addition, many different can downlights with varying can housing sizes can be used to provide lighting for a space.

Light emitting diode (LED) and other solid state devices are becoming increasingly used in many lighting applications and have been integrated into a variety of lighting fixtures. Use of LED light sources in lighting fixtures can provide increased efficiency, life and durability, can produce less heat, and can provide other advantages relative to traditional incandescent and fluorescent lighting systems. Moreover, the efficiency of LED light sources has increased such that higher power can be provided at lower cost to the consumer. Providing LED light sources for use in recessed downlights can be beneficial in many applications.

BRIEF DESCRIPTION

Aspects and advantages of embodiments of the present disclosure will be set forth in part in the following description, or may be learned from the description, or may be learned through practice of the embodiments.

One example aspect is directed to a lighting fixture adapted to fit at least partially within a can housing. The lighting fixture can include a fixture housing having a recess. The fixture housing can have a size adapted to fit at least partially within the can housing. One or more lighting sources can be disposed within the recess of the fixture housing. The lighting fixture can include an adjustable mounting bracket attached to the fixture housing. The adjustable mounting bracket can be slidably movable between a plurality of different positions while a fastener is at least partially secured to the adjustable mounting bracket to adapt the adjustable mounting bracket for engaging can housings of a plurality of different sizes.

Other example aspects of the present disclosure are directed to systems, methods, devices, circuits and apparatus associated with lighting fixtures for can downlights.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
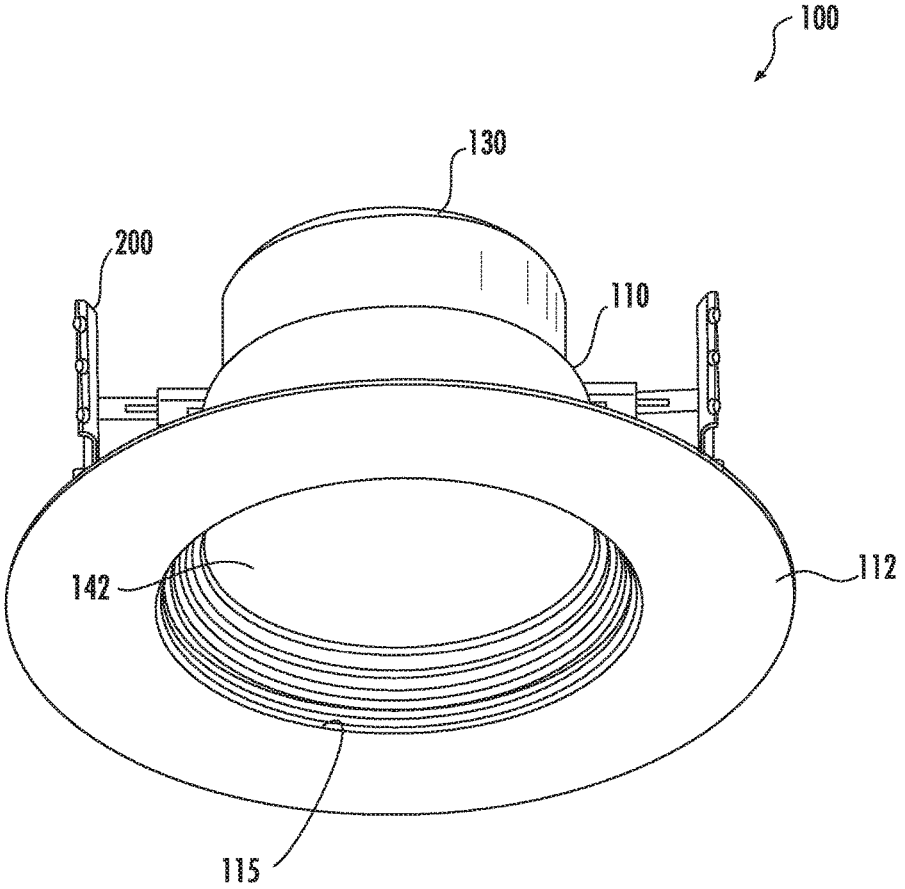
FIG. 1 depicts a perspective view of an example lighting fixture according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed a downlight for providing illumination in a variety of spaces. The downlight can be placed into a can housing, for instance, to provide a light emitting diode (LED) lighting source from the can housing. According to example aspects of the present disclosure, the lighting fixture can include an adjustable mounting bracket that allows for the lighting fixture to be easily adapted and placed into can housings of a variety of different sizes.

In some embodiments, a lighting fixture can be adapted to fit at least partially within a can housing. The lighting fixture can include a fixture housing having a recess. The fixture housing can have a shape adapted to fit at least partially within a can housing. The lighting fixture can include one or more light sources disposed with the recess of the housing. The lighting fixture can further include an adjustable mounting bracket attached to the housing. The adjustable mounting bracket is movable between a plurality of different positions to adapt the adjustable mounting bracket for engaging can housings of a plurality of different sizes.

For example, in some embodiments, the adjustable mounting bracket can include a plurality of mounting arms slidably engaged with at least one sliding track member. Each mounting arm can include an engaging bracket configured to at least partially engage a sidewall of a can housing. The mounting arms can be movable between different positions by sliding along the sliding track member. For instance, the mounting arms can be slidably adjusted to engage a can housing of a 4" diameter, a 6" diameter, a 7" diameter, or other suitable diameter. The sliding track can include an elongated slot to accommodate a fastener such as a screw. The adjustable mounting bracket can be adjusted by loosening the fastener and sliding the mounting arm along the sliding track member while the fastener remains in the elongated slot. The mounting arms can further include anchors to prevent the mounting arm from being completely removed from the sliding track member.

One example embodiment is directed to a lighting fixture adapted to fit at least partially within a can housing. The lighting fixture can include a fixture housing having a recess. The fixture housing can have a size adapted to fit at least partially within the can housing. One or more lighting sources can be disposed within the recess of the fixture housing. The lighting fixture can include an adjustable mounting bracket attached to the fixture housing. The adjustable mounting bracket can be slidably movable between a plurality of different positions while a fastener is at least partially secured to the adjustable mounting bracket to adapt the adjustable mounting bracket for engaging can housings of a plurality of different sizes.

Variations and modifications can be made to this example embodiment. For instance, in some embodiments, the adjustable mounting bracket can include a mounting arm slidably engaged with a sliding track member. The mounting arm can have an elongated slot to accommodate a fastener during sliding of the mounting arm along the sliding track member. The mounting arm can include one or more anchors to prevent removal of the mounting arm from the sliding track. The mounting arm can include an engaging bracket configured to at least partially engage a sidewall of the can housing.

In some embodiments, the sliding track member can be disposed between a portion of a driver housing and the fixture housing. The driver housing can house a driver board having one or more circuits configured to provide power to the one or more light sources.

In some embodiments, the lighting fixture can further include one or more optical elements disposed within the recess. The optical elements can include one or more of a reflector, a lens, or a baffle.

In some embodiments, the lighting fixture can include a trim portion. The trim portion can have a size adapted to cover different sized openings of can housings of a plurality of different sizes. For instance, the trim portion can have a size adapted to cover a 4" inch diameter opening of a can housing, a 4" diameter opening of a can housing, and a 6" diameter opening of a can housing.

Another example embodiment of the present disclosure is directed to a method for installing a lighting fixture in a can housing. The lighting fixture can include a fixture housing having a recess. The fixture housing can have a size adapted to fit at least partially within a can housing. The lighting fixture can further include one or more light sources disposed within the recess of the fixture housing. The lighting fixture can include an adjustable mounting bracket attached to the fixture housing. The method can include slidably adjusting a position of the adjustable mounting bracket while at least a portion of a fastener is disposed in an elongated recess associated with the adjustable mounting bracket. The method can include installing the lighting fixture within the can housing such that the adjustable mounting bracket engages a sidewall of the can housing. In some embodiments, the method can include coupling an Edison connection for powering the lighting fixture to an Edison socket associated with the can housing.

In some embodiments, slidably adjusting a position of the adjustable mounting bracket includes sliding a mounting arm along a sliding track. For instance, slidably adjusting a position if the adjustable mounting bracket can include losing the fastener disposed in the elongated recess in a mounting arm; sliding the mounting arm along a sliding track member while the fastener is at least partially disposed in the elongated recess; and tightening the fastener in the elongated recess.

Another example embodiment of the present disclosure is directed to a lighting fixture. The lighting fixture includes a fixture housing having a recess. The fixture housing has a size adapted to fit at least partially within a can housing. The lighting fixture includes one or more lighting emitting diode light sources disposed within the recess of the fixture housing. The lighting fixture includes one or more optical elements disposed within the recess. The lighting fixture includes a trim portion. The lighting fixture includes a mounting arm having an elongated recess. The lighting fixture includes a sliding track member. The mounting arm can be slidably movable in the sliding track member while a fastener is at least partially disposed in the elongated recess.

In some embodiments, the adjustable mounting bracket can include means for engaging can housings of a plurality of different sizes. Example means for engaging can housings of a plurality of different sizes are discussed and illustrated with reference to FIGS. 1-5.

Figure 2:
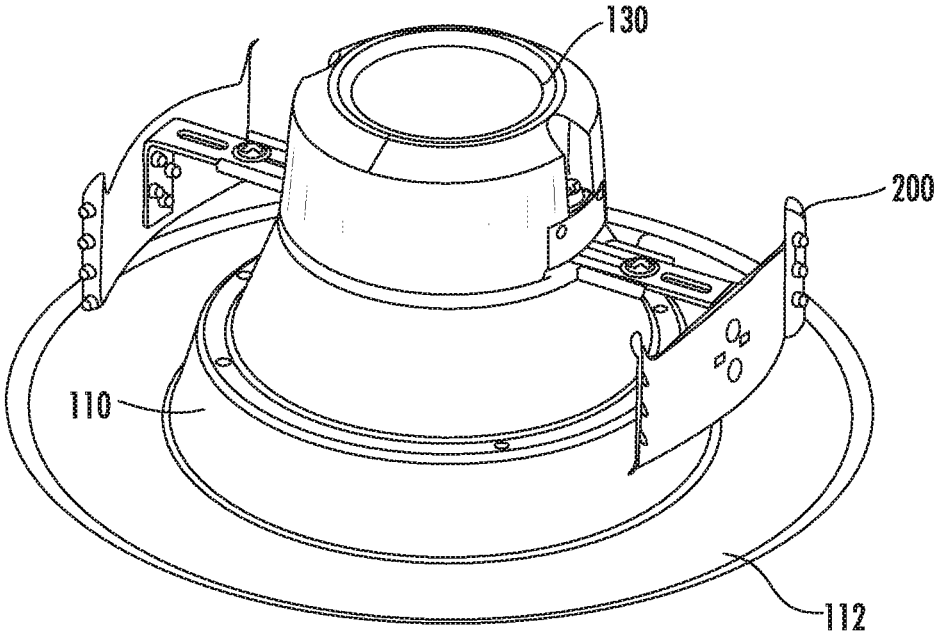
FIG. 2 depicts a perspective view of an example lighting fixture according to example embodiments of the present disclosure.
Figure 3:
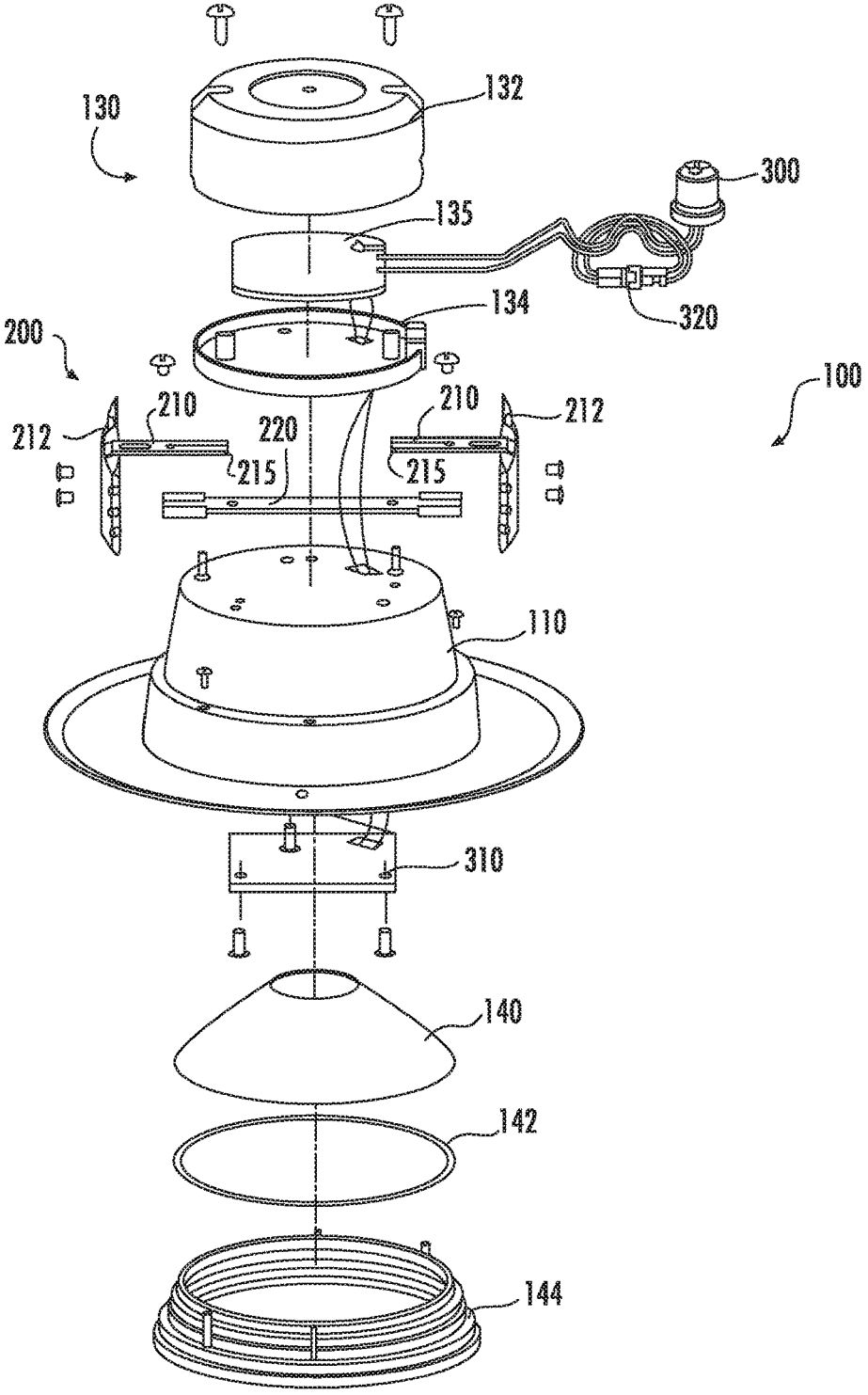
FIG. 3 depicts an exploded view of an example lighting fixture according to example embodiments of the present disclosure.

FIGS. 1-3 depict an example lighting fixture 100 according to example embodiments of the present disclosure. The lighting fixture 100 has a shape adapted to fit at least partially within a can housing. The lighting fixture 100 includes a fixture housing 110. The lighting fixture 100 can include a trim portion 112 that forms a part of or is connected to the fixture housing 110. The fixture housing 110 has a recess 115 for housing one or more light sources and other optical components to provide lighting for a space. The recess 115 can face a generally downward direction when installed in a can housing.

As shown, a light source 310 can be disposed within the recess 115. The light source 310 can include a plurality of light emitting diodes (LEDs) configured to emit light as a result of electrons moving through a semiconductor material. The LEDs can be arranged on a circuit board. In some embodiments, other components (e.g., driver circuits, filter circuits, flicker reducing circuits, etc.) can be disposed on the circuit board for providing a suitable power source for driving the LEDs. In some embodiments, the LEDs can be arranged on the circuit board as part of a light engine.

The present disclosure is discussed with reference to LED light sources for purposes of illustration and discussion. Those of ordinary skill in the art, using the disclosures provided herein, will understand that other light sources can be used without deviating from the scope of the present disclosure.

As further illustrated, one or more optics, such as reflector 140 and lens 142 can be disposed in the recess 110. The reflector 140 can be a reflective cone configured to reflect light emitted from the LEDs of the light source 310 in a generally downward direction. The lens 142 can be, for instance, a glass, polycarbonate, acrylic, or silicone lens (with or without UV protection) or other suitable lens. The lighting fixture 110 can also include a baffle 144. The baffle 144 can be used to reduce glare associated with light emitted from the lighting fixture 100.

The lighting fixture 100 can further include a driver housing 130. The driver housing 130 can include a top portion 132 that can be secured to a bottom portion 134. The driver housing 130 can define a cavity for housing a driver board 135. The driver board 135 can contain suitable electronic circuits (e.g., driver circuits) for converting an input power (e.g., an input 120 V AC power) to a suitable DC power for driving the LED devices of the light source 310.

In some embodiments, the driver board 135 can include a driver circuit. In some embodiments, the driver circuit can be a dimmable driver circuit. The driver circuit can include various components, such as switching elements (e.g. transistors) that are controlled to provide a suitable driver output. For instance, in some embodiments, the driver circuit can include one or more transistors. Gate timing commands can be provided to the one or more transistors to convert the input power to a suitable driver output using pulse width modulation techniques. The driver board can contain electronic components (e.g., capacitors) associated with other circuits for conditioning power for the LED devices, such as filter circuits, flicker reducing circuits, etc.

The driver board 135 can be coupled to an Edison connection 300 through suitable conductors. In some embodiments, a plug adaptor connection 320 can be used to couple the Edison connection 300 to the conductors for powering the driver board 135. The Edison connection 300 can be coupled to an Edison socket located in a can housing to provide power for the lighting fixture 100.

FIG. 3 illustrates the driver circuit as being on a driver board 135 that is separate from the circuit board associated with the light source 310. Those of ordinary skill in the art, using the disclosures provided herein, will understand that in some embodiments, the driver circuit, LEDs and other circuits (e.g., reduced flicker circuits, filter circuits, etc.) can be implemented on the same circuit board.

According to example embodiments of the present disclosure, the lighting fixture 100 can include an adjustable mounting bracket 200. The adjustable mounting bracket 200 can include a sliding track member 220 and a plurality of mounting arms 210.

The mounting arms 210 can be slidably mounted to the sliding track member 220 and secured in place using an appropriate fastener, such as a screw. The mounting arm 220 can include one or more anchors (e.g., protrusions) to prevent the mounting arms from being completely removed from the sliding track member 220.

Each mounting arm 210 can include an engaging bracket 212. The engaging bracket 212 can include an arcuate shape adapted to conform at least partially to a shape of a sidewall of can housing. In some embodiments, the engaging bracket 212 can include a spring member that can deform based at least in part on the shape of the sidewall of a can light fixture when installed in the can housing. In some embodiments, the engaging bracket 212 can include serrated edges to provide increased friction between the engaging bracket 212 and a sidewall of a can housing when installed in the can housing.

Figure 4:
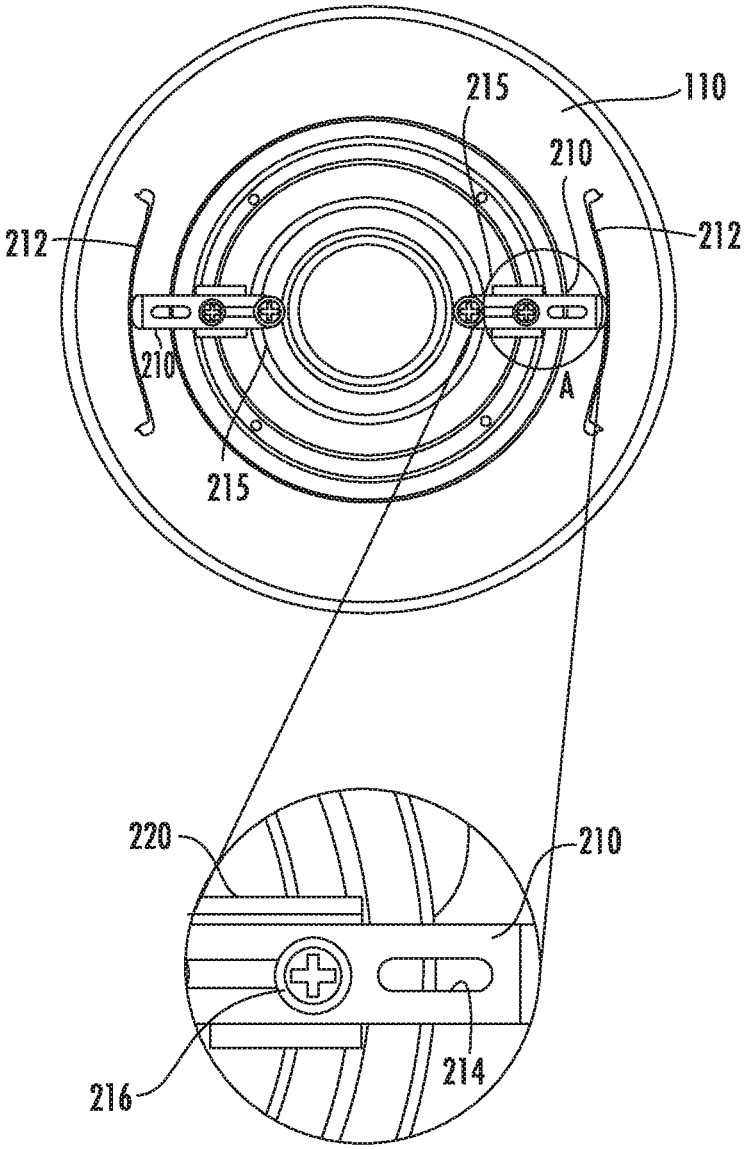
FIG. 4 depicts a plan view of a top portion of an example lighting fixture according to example embodiments of the present disclosure.

FIG. 4 depicts a top view of the adjustable mounting bracket 200 according to example embodiments of the present disclosure. As shown, each of the mounting arms 210 is engaged with a sliding track member 220. Each mounting arm 210 can be configured to slide along a portion of the sliding track member 220 to be adjustable between different positions. Each mounting arm 210 can include one or more elongated slots 214. The one or more elongated slots 214 can be configured to accommodate a fastener 216 (e.g., a screw or other fastening member) at a plurality of different positions so that the mounting arm 210 can be secured at different positions to the sliding track member 220. For instance, a user can easily adjust the mounting bracket 200 by loosening the fastener 216, sliding the mounting arm 210 along the sliding track with the fastener 216 still at least partially disposed in the elongated slot 214, and tightening the fastener 216. In this way, the adjustable mounting bracket 200 can be easily adjustable without having to completely remove the fastener 216 and can provide flexibility in terms of being able to secure the lighting fixture 100 to can housings of different sizes using the mounting bracket.

Figure 5:
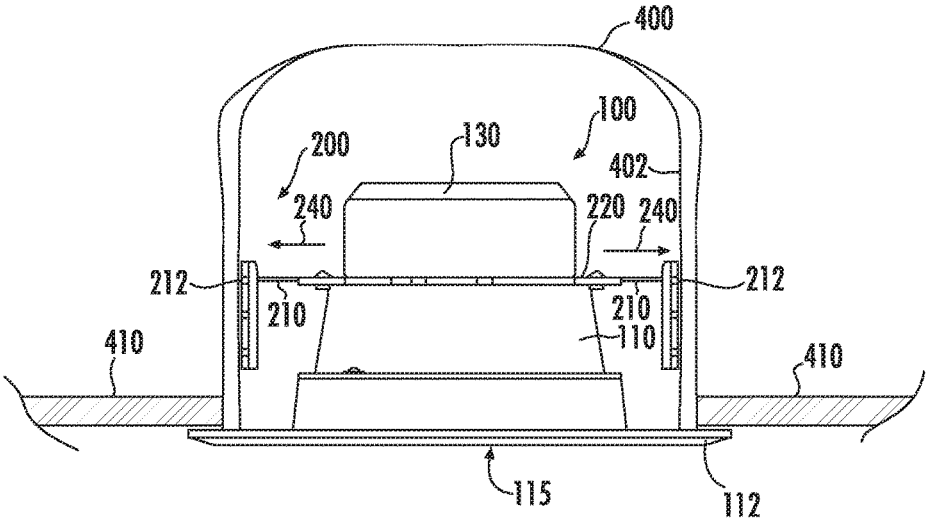
FIG. 5 depicts an example lighting fixture disposed in a can housing according to example aspects of the present disclosure.

For example, FIG. 5 depicts a can housing 400 recessed within a ceiling 310. The lighting fixture 100 can be disposed within the can housing 400. The adjustable mounting bracket 200 can be used to secure the lighting fixture 100 to a sidewall 402 of the can housing. More particularly, the mounting arms 220 can be adjusted in the direction of arrows 240 until the engaging bracket 212 of each mounting arm 212 is at a position that engages the side wall 402 of the can housing 400 when the lighting fixture 100 is installed in the can housing 400.

As shown in FIG. 5, the trim portion 112 of the lighting fixture 100 can be configured to at cover an opening defined by the can housing 400 when the lighting fixture 100 is installed in the can housing 400 so that the internal portions of the can housing 400 are not visible. In some embodiments, the trim portion 112 can be of a sufficient size to accommodate openings of different sized can housings, such as 4" diameter can housings, 5" diameter can housings, 6" diameter can housings, 7" diameter can housings, or other diameter can housings.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A lighting fixture adapted to fit at least partially within a can housing, the lighting fixture comprising:

a fixture housing having a recess, the fixture housing having a size adapted to fit at least partially within the can housing;

one or more light sources disposed within the recess of the fixture housing; and an adjustable mounting bracket attached to the fixture housing, the adjustable mounting bracket comprising a mounting arm and a sliding track member, the mounting arm slidably mounted to the sliding track member;

wherein the mounting arm is slidably movable between a plurality of different positions while a fastener is at least partially secured to the adjustable mounting bracket to adapt the adjustable mounting bracket for engaging can housings of a plurality of different sizes.

2. The lighting fixture of claim 1, wherein the mounting arm has an elongated slot to accommodate a fastener during sliding of the mounting arm along the sliding track member.

3. The lighting fixture of claim 1, wherein the mounting arm comprises one or more anchors to prevent removal of the mounting arm from the sliding track.

4. The lighting fixture of claim 1, wherein the mounting arm comprises an engaging bracket configured to at least partially engage a sidewall of the can housing.

5. The lighting fixture of claim 1, wherein the sliding track member is disposed between a portion of a driver housing and the fixture housing.

6. The lighting fixture of claim 5, wherein the driver housing houses a driver board having one or more circuits configured to provide power to the one or more light sources.

7. The lighting fixture of claim 1, wherein the one or more light sources include one or more light emitting diodes.

8. The lighting fixture of claim 1, wherein the lighting fixture further comprises one or more optical elements disposed within the recess.

9. The lighting fixture of claim 8, wherein the optical elements comprise one or more of a reflector, a lens, or a baffle.

10. The lighting fixture of claim 1, wherein the lighting fixture comprises a trim portion.

11. The lighting fixture of claim 10, wherein the trim portion has a size adapted to cover different sized openings of can housings of a plurality of different sizes.

12. The lighting fixture of claim 10, wherein the trim portion has a size adapted to cover a 4" inch diameter opening of a can housing, a 5" diameter opening of a can housing, and a 6" diameter opening of a can housing.

13. A method for installing a lighting fixture in a can housing, the lighting fixture comprising a fixture housing having a recess, the fixture housing having a size adapted to fit at least partially within a can housing, the lighting fixture further comprising one or more light sources disposed within the recess of the fixture housing, the lighting fixture further comprising an adjustable mounting bracket attached to the fixture housing, the adjustable mounting bracket comprising a mounting arm and a sliding track member, the method comprising:

slidably adjusting a position of the mounting arm along the sliding track member while at least a portion of a fastener is disposed in an elongated recess defined by the mounting arm;

installing the lighting fixture within the can housing such that the adjustable mounting bracket engages a sidewall of the can housing.

14. The method of claim 13, wherein slidably adjusting a position of the mounting arm comprises;

loosening the fastener disposed in the elongated recess defined by the mounting arm;

sliding the mounting arm along the sliding track member while the fastener is at least partially disposed in the elongated recess; and tightening the fastener in the elongated recess.

15. A lighting fixture, the lighting fixture comprising:

a fixture housing having a recess, the fixture housing having a size adapted to fit at least partially within a can housing;

one or more light emitting diode (LED) light sources disposed within the recess of the fixture housing;

one or more optical elements disposed in the recess;

a trim portion; and an adjustable mounting bracket attached to the fixture housing, the adjustable mounting bracket comprising:

a sliding track member; and a mounting arm slidably mounted to the sliding track member, the mounting arm having an elongated recess;

wherein the mounting arm is slidably movable in the sliding track member while a fastener is at least partially disposed in the elongated recess.

16. The lighting fixture of claim 15, wherein the sliding track member is disposed between a portion of a driver housing and the fixture housing.

17. The lighting fixture of claim 15, wherein the trim portion has a size adapted to cover a 4" inch diameter opening of a can housing, a 5" diameter opening of a can housing, and a 6" diameter opening of a can housing.

* * * * *